US005187886A

United States Patent [19]

Wu et al.

[11] Patent Number: 5,187,886

[45] Date of Patent: Feb. 23, 1993

[54] PICTURE FRAME

[76] Inventors: Chii-Chong Wu, No. 389, Sec. 3, Fuhsing Rd.; Der-Shing Wang, No. 14, Lane 349, Minchuean Rd., both of Taichung, Taiwan

[21] Appl. No.: 756,801

[22] Filed: Sep. 9, 1991

[51] Int. Cl.[5] ..... A47G 1/06

[52] U.S. Cl. ..... 40/152.1; 40/156; 248/497

[58] Field of Search ..... 40/152, 152.1, 155, 40/156, 158.1; 248/497; 403/401, 402, 403

[56] References Cited

U.S. PATENT DOCUMENTS

| | | | |
|---|---|---|---|
| 2,581,843 | 1/1952 | Edwards | 40/156 X |
| 2,641,427 | 6/1953 | Krogh | 248/497 X |
| 4,932,146 | 6/1990 | Long | 40/156 |
| 5,092,063 | 3/1992 | Shultz | 40/155 X |

FOREIGN PATENT DOCUMENTS

| | | | |
|---|---|---|---|
| 1557554 | 3/1968 | France | 40/152 |

*Primary Examiner*—Kenneth J. Dorner
*Assistant Examiner*—Brian K. Green
*Attorney, Agent, or Firm*—Lalos & Keegan

[57] ABSTRACT

A picture frame including a pair of horizontal bars and a pair of vertical bars each having two end portions, a space formed in each of the end portions of the bars, a coupler disposed in each of the corner areas of the picture frame and including two legs perpendicular with each other and engageable within the spaces of the bars so that the bars can be coupled together by the couplers, and a strip having a hook formed on each end and engageable within the orifices formed in the ribs so that the bars can be coupled together.

4 Claims, 2 Drawing Sheets

PICTURE FRAME

BACKGROUND OF THE INVENTION

1. Field of the Invention

The present invention relates to a frame, and more particularly to a picture frame.

2. Description of the Prior Art

A typical picture frame has a rectangular shape including four bars secured to one another by nails or screws. In order to assemble the picture frame, a hammer or a pincer is required as well as a plurality of nails. This is very inconvenient.

SUMMARY OF THE INVENTION

The primary objective of the present invention is to provide an improved picture frame which can be easily assembled without additional tools.

In accordance with the preferred embodiment of the invention, there is provided a picture frame including a pair of horizontal bars and a pair of vertical bars each including two end portions and having a space formed therein, and a rib longitudinally formed on the bars and arranged such that a gap is formed between the rib and the space for engagement with an object to be displayed, a coupler being provided in each of the corner areas of the picture frame and including two legs perpendicular to each other and formed integral with each other and received in the spaces of the vertical bars and the horizontal bars so that the vertical bars and the horizontal bars can be coupled together by the couplers, each of the ribs of the vertical bars including an orifice formed therein, and a strip including two ends each having a hook portion formed thereon, the hook portions of the strip being engageable within the orifices of the ribs so that the vertical bars and the horizontal bars can be coupled together.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
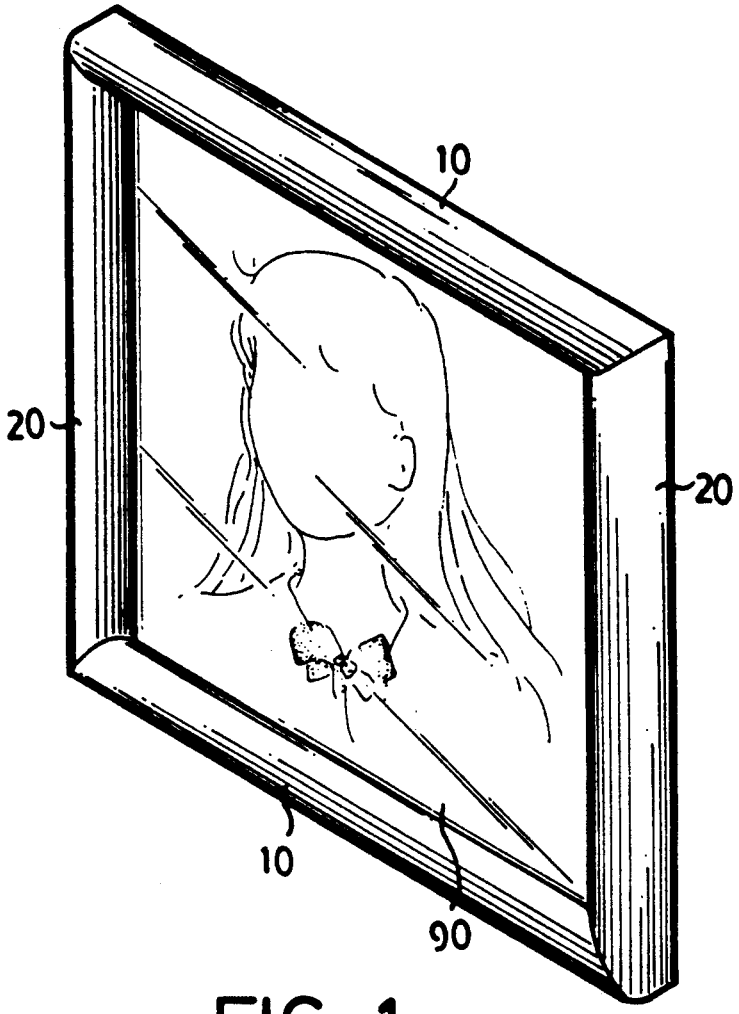
FIG. 1 is a perspective view of a picture frame in accordance with the present invention.
Figure 2:
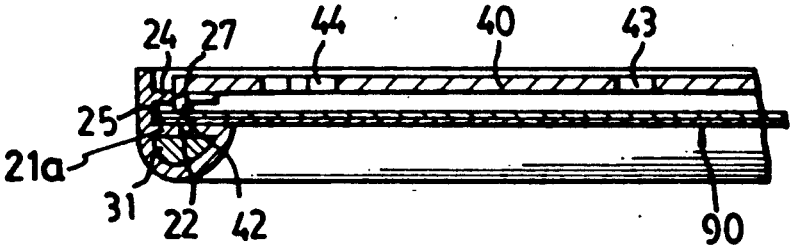
FIG. 2 is a partial cross sectional view of the picture frame.
Figure 3:
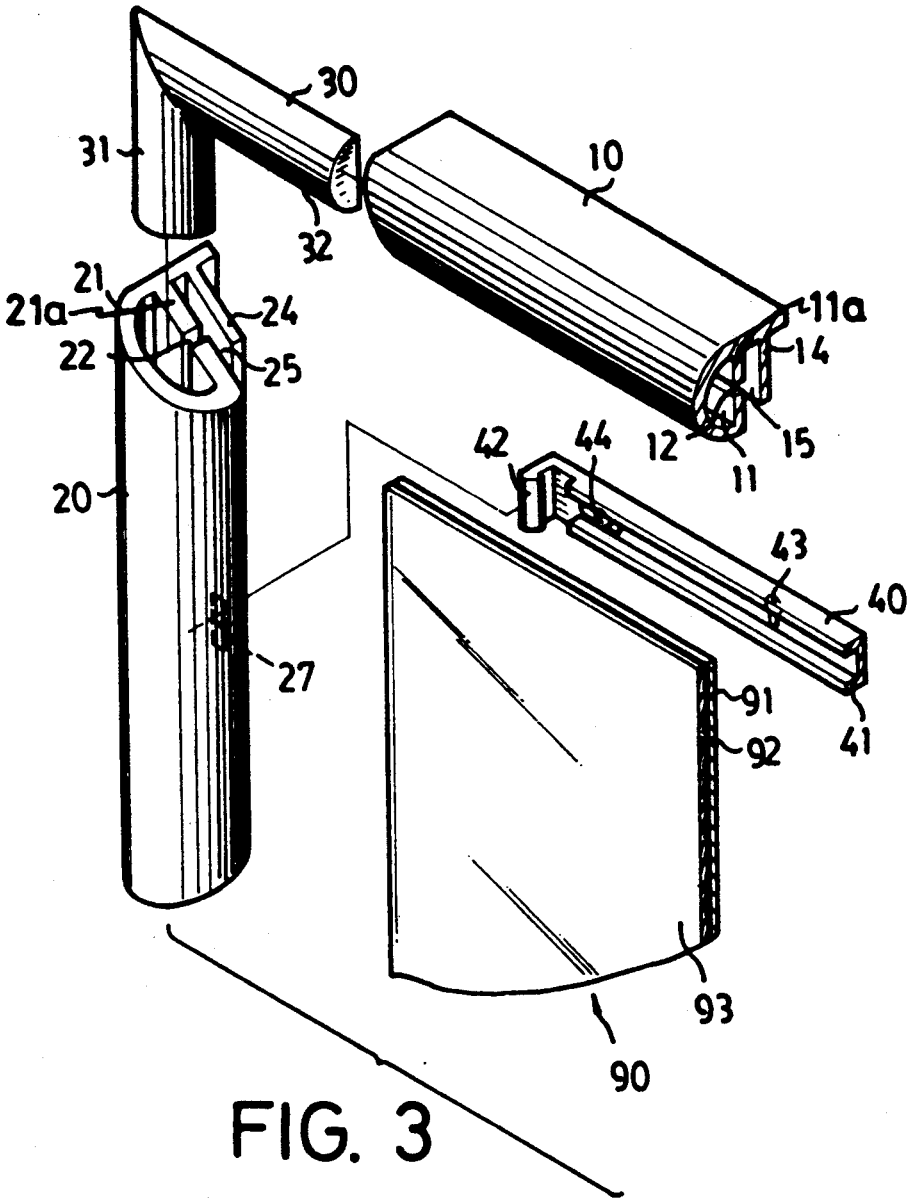
FIG. 3 is a partial exploded view of the picture frame.

Referring to the drawings, a picture frame in accordance with the present invention is generally provided for supporting an object 90 to be displayed, a mirror or the like. As shown in FIG. 3, the object 90 may include a panel 91 having a picture 92, photograph, painting, collage or any other display mounted thereupon such as rare postage stamps, pressed flowers or the like. The panel 91 may comprise likewise any stiff or flexible material such as cardboard, wood, canvas or the like. The object 90 may further include a transparent plastic overlay sheet 93 or a transparent sheet of glass disposed upon the picture 92.

The picture frame comprises generally a pair of horizontal bars 10 and a pair of vertical bars 20 coupled together by four couplers 30 each including two legs 31, 32 perpendicular to each other and formed integral with each other. Each of the legs 31, 32 has a semi-circular cross section. Each of the bars 10, 20 includes two end portions each being cut with a slope of 45° such that the end portions of the bars 10, 20 engage each other. Each of the bars 10, 20 has a space 11, 21 longitudinally formed therein or formed in at least each of the end portions thereof and having a semi-circular cross section similar to that of the legs 31, 32 of the couplers 30 so that the legs 31, 32 can be engaged within the respective spaces 11, 21.

A slot 12, 22 is preferably formed in a wall 11*a*, 21*a* for defining the space 11, 21 so that the legs 31, 32 which are of slightly larger than the spaces 11, 21 can be force-fitted within the respective spaces 11, 21. Each of the bars 10, 20 includes a rib 14, 24 formed integrally on a rear portion thereof and arranged such that a gap 15, 25 is formed between the rib 14, 24 and the respective wall 11*a*, 21*a* for defining the spaces 11, 21. The periphery of the object 90 can be engaged within the gaps 15, 25 so that the object 90 can be stably retained in place.

A strip 40 has a substantially C-shaped cross section including a pair of flanges 41 formed thereon and includes two ends each having a hook portion 42 formed thereon and extended at the same side of the flanges 41. As shown in FIG. 3, an orifice 27 is formed in the rib 24 of each of the vertical bars 20. When assembling the picture frame, it is only required to press the hook portions 42 of the strip 40 into the orifices 27 of the ribs 24 so that the vertical bars 20 can be secured together, and thus, the horizontal bars 10 can be stably retained in place by the couplers 30. In order to further stably couple the bars 10, 20 together, two or more strips 40 may be provided for coupling the bars 10, 20 together. Alternatively, the horizontal bars 10 can be coupled together by the strip 40. The flanges 41 of the strip 40 are arranged such that object 90 can be pressed in place against the wall 11*a*, 21*a* by the flanges 41. Two openings 43, 44 are formed in the strip 40 so that the strip 40 and thus the picture frame can be hung on a nail or the like.

Accordingly, the picture frame in accordance with the present invention can be easily assembled without tools.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A picture frame comprising:

a pair of horizontal bars and a pair of vertical bars, each including two end portions, each end portion being cut with a 45-degree slope so that said end portions of said vertical bars and said horizontal bars abut each other to form four corner areas;

a space longitudinally formed in each of said horizontal bars and said vertical bars, each of said horizontal bars and said vertical bars including a wall for defining said space;

a rib longitudinally formed on each of said horizontal bars and said vertical bars and arranged such that a gap is formed between said rib and said wall for engagement with an object to be displayed, each of said ribs of said vertical bars including an orifice formed therein;

a coupler provided in each of said four corner areas, each of said couplers including two legs perpendicular to each other and formed integral with each other, said legs being received in said spaces of said vertical bars and said horizontal bars so as to couple said vertical bars and said horizontal bars together; and a strip including two ends, each of said ends having a hook portion formed thereon, said hook portions of said strip being engaged in said orifices of said ribs of said vertical bars so as to couple said vertical bars together;

wherein said legs of said coupler are of a larger size than the size of said spaces and said wall of each of said vertical bars and said horizontal bars includes a slot longitudinally formed therein so that said legs of said couplers can be force-fitted within said spaces.

2. A picture frame comprising:

a pair of horizontal bars and a pair of vertical bars, each including two end portions, each end portion being cut with a 45-degree slope so that said end portions of said vertical bars and said horizontal bars abut each other to form four corner areas;

a space longitudinally formed in each of said horizontal bars and said vertical bars, each of said horizontal bars and said vertical bars including a wall for defining said space;

a rib longitudinally formed on each of said horizontal bars and said vertical bars and arranged such that a gap is formed between said rib and said wall for engagement with an object to be displayed, each of said ribs of said vertical bars including an orifice formed therein;

a coupler provided in each of said four corner areas, each of said couplers including two legs perpendicular to each other and formed integral with each other, said legs being received in said spaces of said vertical bars and said horizontal bars so as to couple said vertical bars and said horizontal bars together; and a strip including two ends, each of said ends having a hook portion formed thereon, said hook portions of said strip being engaged in said orifices of said ribs of said vertical bars so as to couple said vertical bars together;

wherein said strip has a substantially C-shaped cross section and includes a pair of flanges formed thereon and arranged for pressing said object so that said object can be retained in place.

3. A picture frame comprising:

a pair of horizontal bars and a pair of vertical bars, each including a wall and two end portions, each end portion being cut with a 45-degree slope so that said end portions of said vertical bars and said horizontal bars abut each other to form four corner areas;

a space formed in each of said end portions of said vertical bars and said horizontal bars;

a rib longitudinally formed on each of said vertical bars and said horizontal bars and arranged such that a gap is formed between said rib and said wall for engagement with an object to be displayed, each of said ribs of said vertical bars including an orifice formed therein;

a coupler provided in each of said four corner areas, each of said couplers including two legs perpendicular to each other and formed integral with each other, said legs being received in said spaces of said vertical bars and said horizontal bars so as to couple said vertical bars and said horizontal bars together;

a strip including two ends each having a hook portion formed thereon, said hook portions of said strip being engaged in said orifices of said ribs of said vertical bars so as to couple said vertical bars together;

wherein said legs of said coupler are of a larger size than the size of said spaces and said wall of each of said vertical bars and said horizontal bars includes a slot longitudinally formed therein so that said legs of said couplers can be force-fitted within said spaces.

4. A picture frame comprising:

a pair of horizontal bars and a pair of vertical bars, each including a wall and two end portions, each end portion being cut with a 45-degree slope so that said end portions of said vertical bars and said horizontal bars abut each other to form four corner areas;

a space formed in each of said end portions of said vertical bars and said horizontal bars;

a rib longitudinally formed on each of said vertical bars and said horizontal bars and arranged such that a gap is formed between said rib and said wall for engagement with an object to be displayed, each of said ribs of said vertical bars including an orifice formed therein;

a coupler provided in each of said four corner areas, each of said couplers including two legs perpendicular to each other and formed integral with each other, said legs being received in said spaces of said vertical bars and said horizontal bars so as to couple said vertical bars and said horizontal bars together;

a strip including two ends each having a hook portion formed thereon, said hook portions of said strip being engaged in said orifices of said ribs of said vertical bars so as to couple said vertical bars together;

wherein said strip has a substantially C-shaped cross section and includes a pair of flanges formed thereon and arranged for pressing said object so that said object can be retained in place.

* * * * *